US010214408B2

(12) United States Patent
Istin

(10) Patent No.: US 10,214,408 B2
(45) Date of Patent: Feb. 26, 2019

(54) DRINK-DISPENSING DEVICE, CONTROL SYSTEM, AND DRINK-DISPENSING METHOD

(71) Applicant: NDMAC SYSTEMS, Pluguffan (FR)

(72) Inventor: Jean-Francois Istin, Combrit (FR)

(73) Assignee: NDMAC SYSTEMS, Pluguffan (FR)

( * ) Notice: Subject to any disclaimer, the term of this patent is extended or adjusted under 35 U.S.C. 154(b) by 0 days.

(21) Appl. No.: 15/125,760

(22) PCT Filed: Mar. 16, 2015

(86) PCT No.: PCT/EP2015/055382
§ 371 (c)(1),
(2) Date: Sep. 13, 2016

(87) PCT Pub. No.: WO2015/136115
PCT Pub. Date: Sep. 17, 2015

(65) Prior Publication Data
US 2017/0001851 A1 Jan. 5, 2017

(30) Foreign Application Priority Data
Mar. 14, 2014 (FR) ..... 14 52159

(51) Int. Cl.
*B67D 1/00* (2006.01)
*B67D 1/08* (2006.01)
(Continued)

(52) U.S. Cl.
CPC ..... *B67D 1/0888* (2013.01); *B67D 1/0006* (2013.01); *B67D 1/0462* (2013.01);
(Continued)

(58) Field of Classification Search
CPC .. B67D 1/0888; B67D 1/0041; B67D 1/0861; B67D 1/0859
(Continued)

(56) References Cited

U.S. PATENT DOCUMENTS 5,291,004 A 3/1994 Frank et al.
5,913,454 A 6/1999 McHale
(Continued)

FOREIGN PATENT DOCUMENTS

AT 6 803 U1 4/2004
FR 2 772 738 A 6/1999
(Continued)

OTHER PUBLICATIONS

International Search Report, dated Jul. 22, 2015, from corresponding PCT application.

*Primary Examiner* — Jeremy Carroll
(74) *Attorney, Agent, or Firm* — Young & Thompson

(57) ABSTRACT

A liquid-dispensing device includes: a table, including a body and a plate, the body including three casks containing a liquid, each cask including a shell in which a pouch, made of a flexible material and containing the liquid, is positioned; three draft circuits, extending from each cask to three dispensing taps; a system for cooling the draft circuit; three pressurized draft systems for drawing the liquid from each cask, the draft system including a solenoid valve in each draft circuit, between the cask and the tap; a system for managing the device, the managing system being provided to control dispensing by opening or closing the solenoid valve; and wheels enabling movement of the device. The plate includes: three liquid-dispensing taps; and a unit for interacting with the management system, which is suitable for interfacing with the liquid-dispensing control. The managing system is connected to a database via a connector.

14 Claims, 4 Drawing Sheets

(51) Int. Cl.

| | |
|---|---|
| ***B67D 1/16*** | (2006.01) |
| ***B67D 1/04*** | (2006.01) |
| ***B67D 1/12*** | (2006.01) |
| *B67D 1/14* | (2006.01) |

(52) U.S. Cl.
CPC ..... *B67D 1/0804* (2013.01); *B67D 1/0859* (2013.01); *B67D 1/0874* (2013.01); *B67D 1/0884* (2013.01); *B67D 1/1234* (2013.01); *B67D 1/1243* (2013.01); *B67D 1/1272* (2013.01); *B67D 1/16* (2013.01); *B67D 2001/0811* (2013.01); *B67D 2001/0822* (2013.01); *B67D 2001/0828* (2013.01); *B67D 2001/1483* (2013.01); *B67D 2210/00031* (2013.01); *B67D 2210/00044* (2013.01); *B67D 2210/00089* (2013.01); *B67D 2210/00091* (2013.01); *B67D 2210/00133* (2013.01)

(58) Field of Classification Search
USPC ..... 222/129.1
See application file for complete search history.

(56) References Cited

U.S. PATENT DOCUMENTS

| | | | | |
|---|---|---|---|---|
| 8,746,507 | B2 * | 6/2014 | Metropulos ..... | B67D 1/0888 222/129.1 |
| 2007/0095859 | A1 | 5/2007 | Maser et al. | |
| 2007/0131715 | A1 * | 6/2007 | Minard ..... | 222/145.5 |
| 2014/0053944 | A1 | 2/2014 | Wang | |
| 2014/0069953 | A1 * | 3/2014 | Metropulos ..... | B67D 1/0041 222/129.1 |

FOREIGN PATENT DOCUMENTS

| | | | |
|---|---|---|---|
| GB | 2 391 220 | A | 2/2004 |
| GB | 2 458 929 | A | 10/2009 |
| WO | 2007/008180 | A2 | 1/2007 |
| WO | 2011/000021 | A1 | 1/2011 |
| WO | 2011/107146 | A9 | 9/2011 |

* cited by examiner

DRINK-DISPENSING DEVICE, CONTROL SYSTEM, AND DRINK-DISPENSING METHOD

TECHNICAL FIELD OF THE INVENTION

The present invention concerns a device for dispensing liquids, a control system including such a device and a method of dispensing a liquid. It applies in particular to the dispensing of drinks. For example for dispensing soft drinks, beer, cider, wine, tea, juice.

Devices are disposed individually or in multiple numbers, sold or leased for a period that can vary from one day to one year, or made available.

The places of use are bars, restaurants, boats, premises of associations, vacation or sports clubs, festivals, campsites, bowling alleys, casinos, etc. They are particularly suitable for remote locations where access is difficult.

PRIOR ART

Installations for storing liquids and dispensing them by means of the pressure of carbon dioxide ($CO_2$) are known.

These installations are large and heavy. These systems cannot be installed outside bars because installation thereof does not hesitate a particular technical knowledge for maintaining and servicing the casks.

The document FR2772738 proposes an installation for storing and dispensing carbonated drinks.

This type of installation is not optimized in so far as its carbon balance is concerned, however. The type of cask used is bulky and made of metal. The material of the cask does not make it possible to optimize the carbon balance of such an installation. Metal casks generate maintenance costs and a service time that is lengthy in terms of management, such as for example cleaning with water and the fact of being on deposit. In fact, the constraint of recovering (and therefore of transporting) casks on deposit and the cleaning constraint are behind the poor carbon balance.

The terms "carbon balance" designate a tool for accounting for emissions of greenhouse gases, having to take account of the primary energy and the final energy of the products and services.

Another disadvantage of this type of installation is to be limited in terms of diversity of the offer because this device is limited to a single type of drink.

OBJECT OF THE INVENTION

The present invention aims to remedy these disadvantages.

To this end, in accordance with a first aspect, the present invention is directed to a liquid-dispensing device forming a table comprising a body and a plate:

the body includes three casks containing a liquid to be dispensed, each cask comprising a shell inside which a pouch made of a flexible material and containing the liquid is positioned, three draft circuits extending from each cask to three dispensing taps, a system for cooling the draft circuit, three pressurized draft systems for drawing the liquid from each cask, said draft system comprising a solenoid valve in each draft circuit between the cask and the tap, a system for managing the device adapted to control the dispensing of liquids by opening or closing the solenoid valve, and castors adapted to enable movement of the device, the plate includes: three liquid-dispensing taps and means for interacting with the management system adapted to interface with the function controlling the dispensing of liquids, said management system being connected to a database via connection means.

Each cask consists of a PET (polyethylene terephthalate) shell inside which is positioned a flexible material pouch containing the liquid. Each cask is of cylindrical shape and includes a PET handle. Each cask is preferably made from a material that can be recycled. The cask is disposable and recyclable. The use of these casks implies an improved carbon balance and does not necessitate transportation for recovery and cleaning. There is no deposit on the cask. The use of three casks makes it possible to have some choice without taking up too much room. Moreover, the absence of contact between the air blown into the cask, between the shell and the flexible pouch, and the liquid ensures a longer shelf life than with a draft system from metal casks relying on gas pressure, of the order of three weeks for beer according to the technical features provided as against three to four days.

Thanks to this device, the carbonated drink is maintained at required temperature whilst preserving the taste of the drink.

Moreover, cooling system of the draft circuit makes it possible to cool the solenoid valves and avoids the creation of foam when there is no draft for some time, all of the draft line being cooled as far as the tap.

The device is therefore autonomous, because it can be installed anywhere and necessitates no particular skill. Cask changing is a simple process.

The database is situated on a host server. On each action of a customer, the management system interrogates the database and if necessary updates it via the connection means.

The database management system makes it possible to be associated with one or more tables, which makes it possible to manage a plurality of places at the same time.

The castors enable the device to be moved. The device necessitates just one electrical socket outlet to be supplied with power. In one embodiment of the invention, the device comprises a battery.

Embodiments of the invention include a plurality of casks and taps for dispensing liquids.

The device therefore offers the possibility of having a plurality of types of liquid.

In embodiments of the invention the connection means are wired or wireless.

The connection means operate in real time and wirelessly. For example using WiFi (registered trade mark designates a set of wireless communication protocols governed by the standards of the group IEEE 802.11, ISO/IEC 8802-11) or a telecommunications network.

The real time aspect is defined by the fact that information is transmitted to the microcontroller or collected without waiting for the end of exchanges of information. For example, there are exchanges of information with the microcontroller during the dispensing of liquid.

A wired connection may be substituted for the wireless connection.

In embodiments of the invention, each cask is thermally insulated from the other casks by a separating wall.

The device therefore integrates different types of liquid to store them and to dispense them at different temperatures. Each cask has its own temperature.

In embodiments of the invention, the pressurized draft system comprises:

means for blowing a gas into the cask between the shell and the flexible material pouch, a solenoid valve in the draft circuit between the cask and the tap, a flow meter adapted to measure the flow rate of liquid in the draft circuit.

In embodiments of the invention, the cooling system comprises a cooling circuit a heat exchange fluid of which passes through an evaporator, an expansion valve, a condenser and a compressor.

The cooling system is fast in operation and avoids the disadvantages linked to the use of water.

In embodiments of the invention, the management system includes:

a microcontroller connected by a wireless connection in real time to a database, a temperature probe adapted to measure the temperature of the cask, a pressure probe adapted to measure the pressure inside the cask.

In one embodiment of the invention, each solenoid valve is positioned at the level of the taps, said solenoid valves are cooled by the cooling system. Having the solenoid valves placed at the level of the taps makes it possible for the liquid contained in the draft circuit to be cooled. This avoids the formation of foam with the quantity of liquid remaining in the draft circuit.

In embodiments of the invention, the management system includes means for recognizing the cask to identify the liquid and to transmit information to the microcontroller.

The recognition means also identify the producer and the batch number and make it possible to track the casks.

Recognition of the cask therefore transmits information to the database for transmission of the storage temperature and pressure permitted for extracting the liquid from the cask at the correct temperature and pressure.

In embodiments of the invention, the database includes information on the type of liquid in the cask, information on a customer account.

The customer account information will serve to determine the volume of liquid that the customer is authorized to serve himself or herself. Information is also added on authorized volume, percentage alcohol, type of drinks, opening times . . . .

In accordance with a second aspect, the present invention is directed to a control system is digital tablet, a computer or a mobile telephone and said control system comprises means for wireless communication with said device.

In accordance with a third aspect, the present invention is directed to a method comprising the following steps:

connecting the cask to a device as claimed in claim 1;

interrogating a customer account information database;

controlling the opening of the liquid-dispensing tap in accordance with a limit liquid volume as a function of the customer account information.

The customer account information enables the customer to log on to their account. The limit volume is determined by the credit of the customer account and avoids having some other person serving himself or herself on the account of a customer if they forget to log off.

Another operating possibility enables the customer to choose their quantity (number of glasses, the content of which in centiliters corresponds to the limit liquid volume). The flow meter counts the centiliters and when the maximum quantity is reached or the customer runs out of credit, the microcontroller orders the solenoid valve to close (closing the dispensing tap) and the tablet displays a corresponding message (for example: insufficient credit).

BRIEF DESCRIPTION OF THE FIGURES

Other advantages, objects and features of the present invention will emerge from the following description given by way of nonlimiting explanation with reference to the appended drawings, in which.

DESCRIPTION OF EMBODIMENTS OF THE INVENTION

Figure 1:
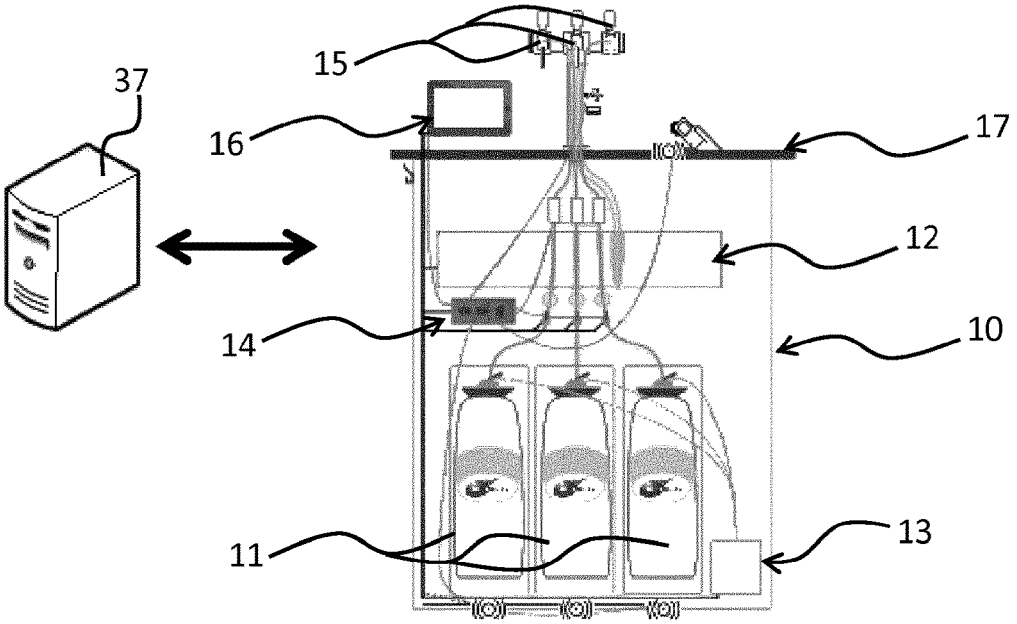
FIG. 1 represents a theoretical diagram in accordance with one embodiment of the invention.

FIG. 1, in accordance with one embodiment of the invention, shows a device for dispensing liquid. The device is in the form of a table. The device includes an electrical power supply, not represented.

The device includes a body 10 in which three casks 11 are disposed. Each cask 11 contains a liquid to be dispensed. The device also comprises a system 12 for cooling a draft circuit 24 disposed between a cask 11 and a dispensing tap 15.

The three dispensing taps are situated substantially at the center of the plate.

The device comprises a pressurized draft system 13 adapted to draw the liquid from the casks 11.

The pressurized draft system 13 comprises for each cask 11:

means for blowing a gas into the cask 11, a solenoid valve 25 positioned in the draft circuit 24 and controlling the exit of the liquid, a flow meter positioned in the draft circuit 24.

The flow meter is connected to the management system 14 to inform the management system 14 of the liquid flow rate. The flow rate information serves to determine the volume remaining in the cask 11 and serves the user as an indication of their remaining balance.

The flow meter of each draft circuit gives flow rate information to the electronic circuit card that is to control the solenoid valves as a function of the associated setpoints.

The solenoid valve 25 functions with the management system 14 that authorizes the dispensing of drink as a function of the status of the customer account.

The customer balance information authorizes the customer to serve himself or herself according to a limit liquid volume.

The casks 11 have a PET shell and a flexible aluminum wall that contains the liquid.

In accordance with one embodiment of the invention, the means for flowing a gas into the cask blows the gas between the PET shell and the aluminum pouch of the cask. The compressed liquid therefore exits via the draft circuit.

In accordance with one embodiment of the invention, an air compressor is located in the body of the device and blows air into the cask.

In accordance with one embodiment of the invention, the blowing means is a cylinder of compressed gas.

In the FIG. 1 example, a compressor 21 compresses air and sends this compressed air into the cask 11 between its shell and the flexible aluminum wall. The air compresses the flexible wall and forces the liquid to exit via the draft circuit 24.

The device also comprises a system 14 for managing the device adapted to control the dispensing of liquids. In one example the management system 14 of the device includes a microcontroller connected by a wireless connection in real time to a database, temperature probes adapted to measure the temperature of the casks 11, pressure sensors adapted to measure the pressure of the casks 11.

The information transmitted to the management system is for example: the CO2 (carbon dioxide) content of the liquid, the type of liquid (soft drink, beer, cider, wine, tea, juice, milk, . . . ), the pressure to be exerted on the cask, the maximum authorized flow rate, the quantity of liquid.

The management system 14 further includes means for recognizing the cask 11 to identify the content and to transmit information to the microcontroller. Such as for example, the type of liquid and data of the producer.

This data serves for example to inform the management system 14 as to the storage temperature of the liquid. The setpoint temperature is transmitted to the cooling system 12 in order to maintain the liquid at the setpoint temperature. Thus the management system 14 controls the liquid storage/dispensing temperature.

In accordance with another example, the management system 14 includes an alert system as a function of a predetermined limit threshold. The alert system is an audible or visual alert. It is this alert that indicates the cask level in order to prepare for its replacement. In this case, the management system 14 integrates communication with a control system of the device. For example, for an installation in a bar, the barman has access to the control system (digital tablet) in order to be alerted when a cask 11 is almost empty. The management system 14 alerts the control system in order to tell the barman to replace the cask 11.

In this example, the control system is a digital tablet, a computer or a mobile telephone that controls a device. In another example, the control system is a digital tablet that monitors a plurality of liquid-dispensing devices.

In accordance with another example, the system includes a satellite geolocation system. Accordingly, in the case of a plurality of devices, the control system has the information as to the coordinates of the device.

The geolocation system, of GPS (Global Positioning System) type informs the database 37 of the satellite coordinates of the location at which the device is situated.

The plate 17 is disposed on top of the device substantially centered. The plate 17 is of circular shape and includes: three liquid-dispensing taps 15. The plate 17 includes means 16 for interacting with the management system 14 of the device adapted to provide the interface with the liquid-dispensing control function.

The plate 17 is removable and can be easily removed for the requirements of handling, replaced by a plate of different shape or adapted to the graphical chart of the premises.

In accordance with one embodiment of the invention, the interaction means comprise a screen displaying various information. The screen is fixed to the device and situated on the plate. In accordance with one embodiment of the invention, the interaction means are in the plate and the interface is the plate itself. In this case the plate displays various information.

In embodiments of the invention, the plate is of rectangular, circular, hexagonal or half-moon shape.

In accordance with one embodiment of the invention, the plate is the shape of a square.

In accordance with one embodiment of the invention, the device includes connection means with another device. In this example, the connection between two devices is provided by a wire to increase the bit rate of the connection between the two devices. In another example, the connection between two devices is wireless to prevent wires being visible between the two devices.

The interaction means 16 comprise a digital tablet controlling the dispensing of liquid. A customer interrogates the tablet to access their account and to request authorization to serve himself or herself.

In accordance with one embodiment of the invention, the draft circuit 24 starts from a cask 11, passes through a solenoid valve 25 and then the means for blocking foam, and enters the cooling system 12 (dry cold).

Figure 2:
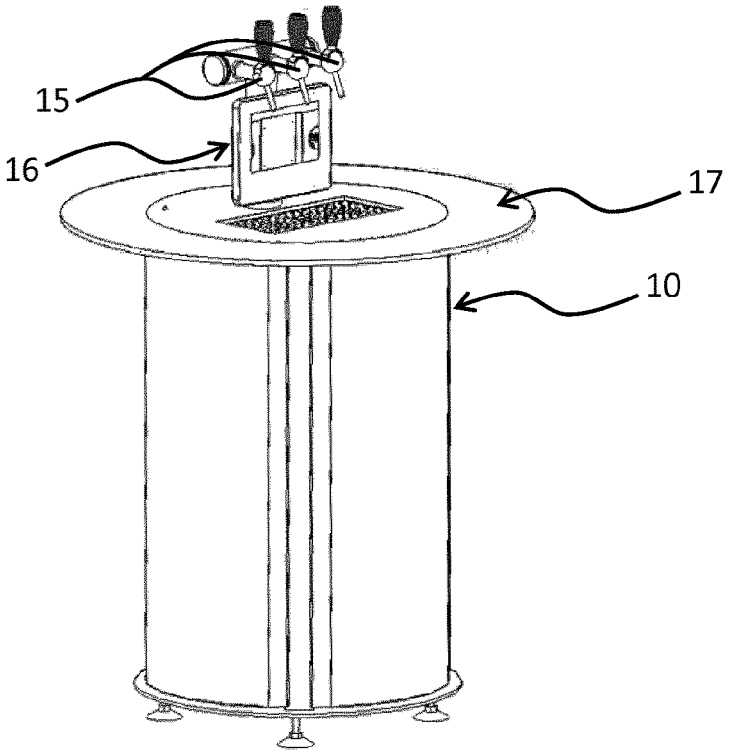
FIG. 2 represents in perspective view one embodiment of the invention.

FIG. 2 represents one embodiment of the invention. The device comprises a plate 17 and a body 10. The plate 17 comprises three liquid-dispensing taps 15. The three dispensing taps 15 are held above a drip tray. The three dispensing taps 15 are fixed to a column.

In one embodiment of the invention the column is cooled by cooling means. The cooling means may be a part of the cooling circuit 23.

The body 10 of the device is in two demountable parts. The body 10 and the various parts that constitute the device are therefore transportable in a standard motor vehicle. Transport is therefore facilitated.

The device comprises a system 12 for cooling the casks 11 including a cooling circuit 23.

Figure 3:
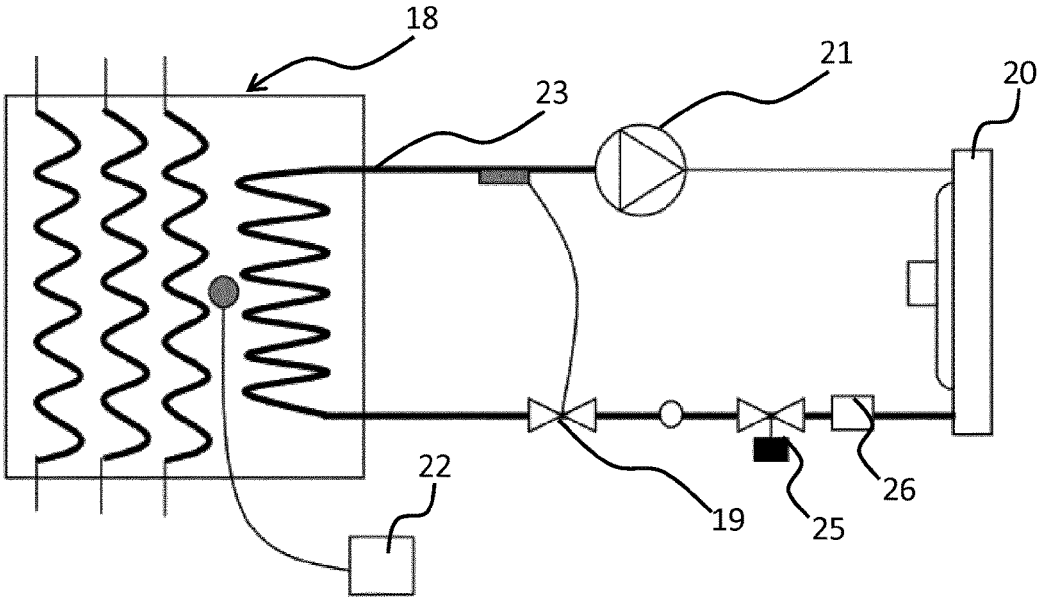
FIG. 3 represents a theoretical diagram of the cooling system in accordance with one embodiment.

FIG. 3 shows the cooling system 12 in which a heat-exchange fluid passes through an evaporator 18, an expansion valve 19, a condenser 20 and a compressor 21. The evaporator 18 cools the liquid from the draft circuit 24. This figure also shows a temperature probe 22 measuring the cooling temperature. The information from the measurement is processed by the management system 14. The cooling circuit 23 comprises a solenoid valve 25 and a dehydrator filter 26. The solenoid valve 25 controls the flow rate of the heat-exchange fluid of the cooling circuit 23 and reduces or increases the cooling temperature.

Figure 4:
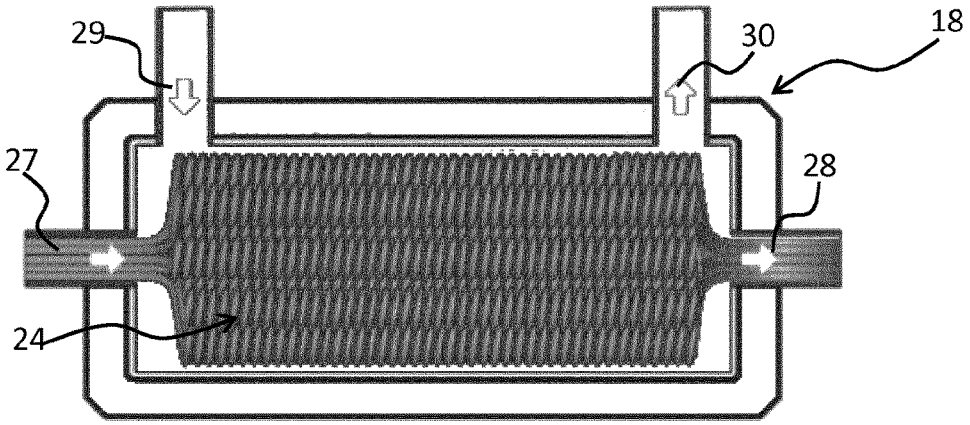
FIG. 4 represents a diagram of an example evaporator of the cooling system in accordance with one embodiment.

FIG. 4 shows one embodiment of evaporator 18. There is shown an inlet 27 of draft circuit 24 and an outlet of the draft circuit 24. The heat-exchange fluid enters via the inlet 29 of the evaporator 18 and exits via the outlet 30. The draft circuit 24 forms coils to favor the exchange of heat. In another example, not represented, the circuit features substantially straight tubes inside the evaporator 18. The material of the coils of the draft circuit 24 conveys the temperature of the heat-exchange fluid of the evaporator 18 to the liquid of the draft circuit 24.

In accordance with one embodiment of the invention, the evaporator is a metal block conducting heat in order to evaporate it. The metal block includes the cooling circuit and the draft circuit for the transfer of heat. In accordance with one embodiment of the invention, the draft circuit enters the interior of the evaporator and forms coils. The liquid entering the evaporator is therefore cooled. In accordance with one embodiment of the invention, the evaporator comprises the passage of the heat-exchange fluid from the cooling circuit and the three draft circuits of the three casks.

In accordance with an example that is not represented, the device comprises movement means. For example, the device comprises three or four castors to facilitate its transportation. The castors are fixed to the bottom of the body 10 of the device. In another embodiment of the invention, the castors are positioned partly under the body 10 (the rotation axis of the castors is inside the body 10 and the castor supports the device to move it).

In accordance with one embodiment of the invention, the displacement means comprise a through-hole adapted to receive a carrying bar. In this case, operators grasp the carrying bar to move the device. Two operators are necessary to transport the device.

In accordance with one embodiment of the invention, the movement means comprise handles situated on the side of the device.

In embodiments of the invention, the plate comprises one of the elements selected from lighting means, a drip tray situated below the dispensing taps, or a column supporting the three dispensing taps.

In accordance with one embodiment of the invention, the lighting means comprise a plurality of LED (light-emitting diode) lamps inside the plate. In this case, the plate comprises above the LED lamps a transparent or opaque glass allowing light to pass.

In accordance with one embodiment of the invention, the plate 17 comprises lighting means. In one embodiment of the invention, LED lamps are inserted in the plate 17 under a (transparent or opaque) window.

In accordance with another example, LED lamps are inserted under the plate 17 to produce a lighting effect. In another variant, lamps are fixed to a support bar fixed to the device. In this case, the lamps illuminate the top of the plate 17.

In accordance with one embodiment of the invention, the lighting means comprise a plurality of lamps situated on top of the device. The lamps are connected by a bar fixed to the device.

In accordance with one embodiment of the invention, the device includes a drip tray to collect and recover any drips from the taps 15. The drip tray is connected to a recovery tank situated inside the body of the device.

In accordance with embodiments of the invention, the body 10 comprises one of the elements selected from a coat-hook fixed to the wall of the body of the device, three doors arranged for access to the three casks, means for blocking foam from the casks, or means for cooling the three casks.

The coat-hook is a wall-mounted support on which garments and diverse objects are hung.

The three doors facilitate access to the cask for changing it.

In accordance with one embodiment of the invention, the device also comprises a door for access to a technical area. In this case, the door includes a lock to prevent access by unauthorized users.

In accordance with one embodiment of the invention, the device comprises a separating wall between the technical area and the casks.

In accordance with one embodiment of the invention, the means for blocking foam from the casks comprise a mechanical valve that automatically cuts off the flow to prevent the creation of foam on changing cask.

In accordance with one embodiment of the invention, the blocking means comprise a float in the draft circuit. When the cask is empty, the float descends in the blocking means and automatically plugs the inlet, allowing only the liquid to pass.

Figure 5:
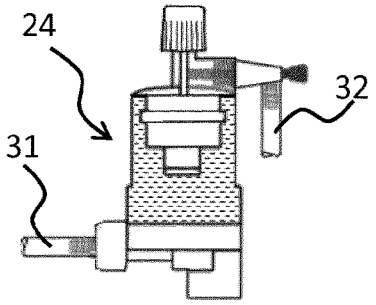
FIG. 5 represents means for blocking foam from the casks allowing the liquid to pass in accordance with one embodiment.
Figure 6:
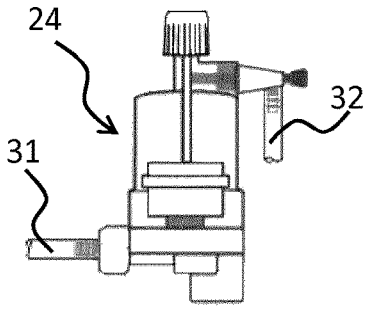
FIG. 6 represents means for blocking foam from the casks blocking the passage of the foam in accordance with one embodiment.

FIGS. 5 and 6 show means for blocking foam from the casks 11.

The means for blocking foam allow the liquid from the draft circuit 24 to pass (see FIG. 5). There are shown an inlet 31 of the means for blocking foam and an outlet 32 of the means for blocking foam. When the cask 11 is empty, there is no longer any liquid and the piston contained in the locking means descends (see FIG. 6) which blocks the foam and prevents it propagating in the draft circuit 24.

In accordance with one embodiment of the invention, each cask 11 is thermally insulated the ones from the others by a separating wall.

In accordance with one embodiment of the invention, the separating wall is a box in which the cask 11 is positioned. In accordance with another embodiment of the invention, the separating wall is the bottom visible when a door is open. The separating wall is useful when the casks 11 are different and their dispensing temperature is different.

When the casks 11 are identical, the insulating wall is of no utility and serves as evaporator 18.

Figure 7:
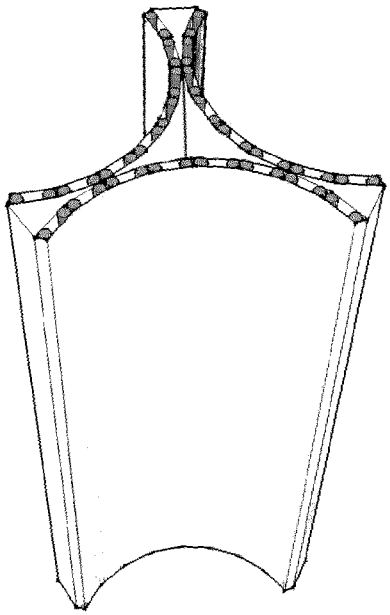
FIG. 7 represents means for cooling the casks in accordance with one embodiment.

FIG. 7 shows an evaporator for maintaining the three casks 11 at the same temperature to maintain the casks 11 at the correct setpoint temperature. In this case, the cooling means serve to cool the casks.

In one example, there are means for cooling the liquid-dispensing column, means for cooling the liquid draft circuit and means for cooling the cask or casks.

In accordance with one embodiment of the invention, the recognition means comprise an RFID (RadioFrequency IDentification) card reader. The RFID card reader is a method of reading for remote data storage and retrieval using markers known as "radio-tags".

In accordance with one embodiment of the invention, the recognition means comprise an NFC (Near Field Communication) card reader. An NFC card reader is a short-range high-frequency wireless communication technology enabling exchange of information between peripheral devices.

The device comprises an NFC card reader. This reader makes it possible to write and to read information on a customer. This data is stored in the database. The account of a customer enables authorization of liquid consumption from the display means.

In accordance with one embodiment of the invention, the NFC card is in the form of a bracelet or a badge.

The control system described above writes on a bracelet the available account balance. When the proprietor of the bracelet interrogates the interaction means of the device, the proprietor of the bracelet accesses reading of their account and serves themselves according to their balance. The device authorizes the proprietor of the bracelet to serve themselves as a function of a volume of liquid.

The casks 11 integrated into the device contain between 20 and 30 liters. Their manipulation is therefore easy compared to casks 11 of 50 to 60 liters.

In accordance with one embodiment of the invention, the device is customized using the colors of sponsors.

Figure 8:
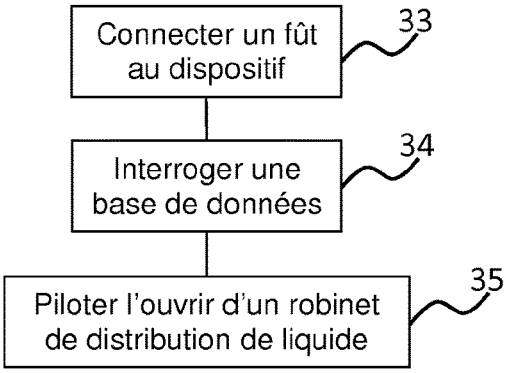
FIG. 8 represents in flowchart form steps executed in one particular embodiment of the method that is the subject matter of the present invention.

FIG. 8 represents the method of dispensing a liquid.

The step 33 concerns the connection of a cask 11 to the device comprising means for cooling the cask 11 including a cooling circuit 23 hermetically isolated from a draft circuit 24 of cask 11. The draft circuit 24 of cask 11 extending from an end connected to a cask 11 and from another end to a liquid dispensing tap 15, said cask 11 comprising a shell and a pouch containing a liquid.

Connecting the cask 11 to the device leads to the identification of the cask 11 by the management system 14. This identification gives the information necessary for the storage of and dispensing from the cask 11 (storage and distribution temperature).

The step 34 concerns the interrogation of a database of a customer account including the customer account balance information.

The step 35 concerns the control of the opening of a liquid-dispensing tap 15 in accordance with a predetermined limit value of the balance information, said control of the opening of the liquid dispensing tap 15 leads to blowing of a gas between the shell of the cask 11 and the flexible wall of the cask 11.

Figure 9:
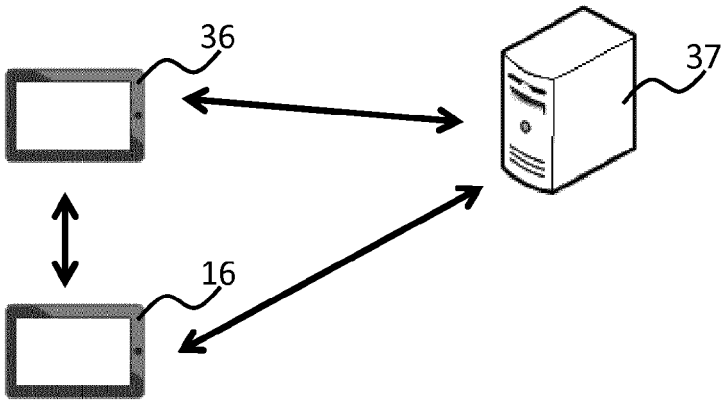
FIG. 9 represents a diagram of communication with interaction means of a device in accordance with one embodiment of the invention.

FIG. 9 represents a diagram of communication between the interaction means 16 of the device and a control system 36 and the database 37. The control system is a tablet providing various services such as tracking the dispensing of drinks, storing customer accounts. The arrows represent the exchanges of information between the interaction means 16 of the device and control system 36 and the database 37.

Figure 10:
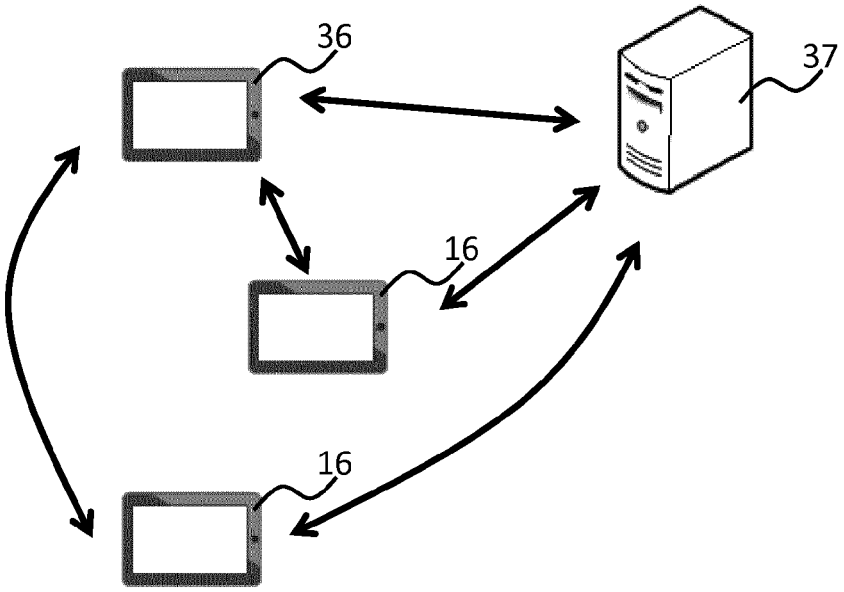
FIG. 10 represents a diagram of communication with two interaction means of a device in accordance with another embodiment of the invention.

FIG. 10 represents a diagram of communication between two interaction means 16 of two devices and a control system 36 and the database 37. According to this variant, there are two devices for dispensing liquids that interact continuously with a digital tablet (control system 37) and a database 36. In the same way, the arrows represent the exchanges of information between the interaction means 16 of the device and control system 36 and the database 37.

The control system is a digital tablet for monitoring a plurality of tables.

REFERENCES

10 Body
11 Cask
12 Cooling system
13 Draft system
14 Management system
15 Tap
16 Interaction means
17 Plate
18 Evaporator
19 Expansion valve
20 Condenser
21 Compressor
22 Temperature probe
23 Cooling circuit
24 Draft circuit
25 Solenoid valve
26 Dehydrator filter
27 Draft circuit inlet
28 Draft circuit outlet
29 Heat-exchange fluid inlet
30 Heat-exchange fluid outlet
31 Foam blocking means inlet
32 Foam blocking means outlet
33 Cask connection step
34 Database interrogation step
35 Step of controlling liquid-dispensing tap opening
36 Control system
37 Database

The invention claimed is:

1. A liquid-dispensing device forming a table comprising:

a body (10);

a plate (17), the plate (17) being removably mounted on a top of the body (10);

three casks (11) disposed in the body (10), each cask containing a liquid to be dispensed, each cask comprising a shell inside which a pouch made of a flexible material and containing the liquid is positioned;

a plurality of liquid-dispensing taps (15), each of the liquid-dispensing taps (15) being connected to a corresponding one of the three liquid-dispensing taps (15), each of the liquid-dispensing taps (15) being located above the plate (17);

a draft circuit (24) for each cask (11), each draft circuit (24) connecting one of the casks (11) and the corresponding one of the three liquid-dispensing taps (15); and a cooling system (12) for cooling each draft circuit, the cooling system (12) being disposed between each cask (11) the corresponding one of the three liquid-dispensing taps (15), the cooling system (12) further comprising an evaporator having i) a first arcuate evaporator element extending vertically in the body (10) with a concave surface of the first arcuate evaporator element located adjacent a first one of the casks (11), ii) a second arcuate evaporator element extending vertically in the body (10) with a concave surface of the second arcuate evaporator element located adjacent a second one of the casks (11), and iii) a third arcuate evaporator element extending vertically in the body (10) with a concave surface of the third arcuate evaporator element located adjacent a third one of the casks (11), wherein a convex surface of the first arcuate evaporator element is adjacent a convex surface of the second arcuate evaporator element and adjacent a convex surface of the third arcuate evaporator element, a convex surface of the second arcuate evaporator element is adjacent a convex surface of the first arcuate evaporator element and adjacent a convex surface of the third arcuate evaporator element, and a convex surface of the third arcuate evaporator element is adjacent a convex surface of the first arcuate evaporator element and adjacent a convex surface of the second arcuate evaporator, a pressurized draft system (13) connected to the cases for drawing the liquid from each cask (11), said draft system (13) comprising, for each cask (11), a solenoid valve (25) positioned in each draft circuit (24) between the one cask and the corresponding one tap, the solenoid valve (25) controlling an exit of the liquid from the one cask;

a management system (14) operatively connected to each solenoid valve (25), the management system (14) for managing the device and adapted to control the dispensing of liquids by opening or closing each solenoid valve (25), said management system (14) being connected, via a connection, to a database (37); and a control unit (16) situated on the plate and operatively connected to the management system (14) for interacting with the management system (14) adapted to interface with the function controlling the dispensing of liquids, the control unit comprising a screen.

2. The device as claimed in claim 1, further comprising castors attached to the body (10), the castors enabling movement of the device.

3. The device as claimed in claim 1, wherein the connection is a wired connection.

4. The device as claimed in claim 1, wherein each cask (11) is thermally insulated from the other casks by a separating wall.

5. The device as claimed in claim 1, wherein the pressurized draft system (13) comprises:

means for blowing a gas into the cask (11) between the shell and the flexible material pouch, a flow meter adapted to measure the flow rate of liquid in the draft circuit (24), a blocking valve located between each cask and the cooling system (12).

6. The device as claimed in claim 1, wherein each solenoid valve is positioned at the level of the taps (15), said solenoid valves (25) are cooled by the cooling system (12).

7. The device as claimed in claim 1, wherein the cooling system (12) comprises a cooling circuit (23) a heat-exchange fluid of which passes through the evaporator (18), an expansion valve (19), a condenser (20) and a compressor (21).

8. The device as claimed in claim 1, wherein the management system (14) includes:

a microcontroller connected by the connection in real time to the database (37), the connection being a wireless connection, a temperature probe adapted to measure the temperature of the cask (11), and a pressure probe adapted to measure the pressure inside the cask (11).

9. The device as claimed in claim 1, wherein the management system (14) includes card reader for recognizing the cask (11) to identify the liquid and to transmit information to the microcontroller.

10. A control system (36) and device as claimed in claim 1, wherein the control system comprises a digital tablet wirelessly connected to said device for wireless communication with said device.

11. A control system (36) and device as claimed in claim 1, wherein the control system comprises a mobile telephone wirelessly connected to said device for wireless communication with said device.

12. A control system (36) and device as claimed in claim 1, wherein the control system is a computer wirelessly connected to said device for wireless communication with said device.

13. The device as claimed in claim 1, wherein the connection is a wireless connection.

14. The device as claimed in claim 1, wherein the pressurized draft system (13) comprises:

means for blowing a gas into the cask (11) between the shell and the flexible material pouch, a flow meter adapted to measure the flow rate of liquid in the draft circuit (24), a blocking float located in each draft circuit (24).

* * * * *